US008104123B2

(12) United States Patent
Paz et al.

(10) Patent No.: US 8,104,123 B2
(45) **Date of Patent: *Jan. 31, 2012**

(54) MULTI-POSITION SUPPORT APPARATUS WITH A MOVABLE FRAME

(76) Inventors: Ohad Paz, Tel Aviv (IL); Ofer Parezky, Nes Ziona (IL)

( * ) Notice: Subject to any disclaimer, the term of this patent is extended or adjusted under 35 U.S.C. 154(b) by 0 days.

This patent is subject to a terminal disclaimer.

(21) Appl. No.: 12/542,913

(22) Filed: Aug. 18, 2009

(65) Prior Publication Data

US 2009/0300845 A1 Dec. 10, 2009

Related U.S. Application Data

(63) Continuation-in-part of application No. 11/715,410, filed on Mar. 8, 2007, which is a continuation-in-part of application No. PCT/IL2006/000575, filed on May 16, 2006, which is a continuation-in-part of application No. 11/130,130, filed on May 17, 2005, and a continuation-in-part of application No. 11/130,129, filed on May 17, 2005.

(60) Provisional application No. 61/090,433, filed on Aug. 20, 2008, provisional application No. 61/097,255, filed on Sep. 16, 2008, provisional application No. 60/738,592, filed on Nov. 22, 2005, provisional application No. 60/715,177, filed on Sep. 9, 2005, provisional application No. 60/715,147, filed on Sep. 9, 2005.

(51) Int. Cl.
*A47B 7/00* (2006.01)
*A47B 7/02* (2006.01)

(52) U.S. Cl. ..... 5/624; 5/610; 5/611; 5/613; 5/618

(58) Field of Classification Search ..... 5/611, 610, 5/624, 613, 612, 602, 600, 617, 618, 621, 5/81.1 C, 81.1 HS; 297/423.1
See application file for complete search history.

(56) References Cited

U.S. PATENT DOCUMENTS 3,997,926 A 12/1976 England (Continued)

FOREIGN PATENT DOCUMENTS

WO WO 2006/123333 11/2006

OTHER PUBLICATIONS

International Preliminary Report on Patentability Dated Nov. 19, 2007 From the International Bureau of WIPO Re. Application No. PCT/IL2006/000575.

(Continued)

*Primary Examiner* — Jonathan Liu

(57) ABSTRACT

A multi-position support apparatus including a base for supporting the apparatus on a flat horizontal surface, a tiltable frame assembly tiltably supported on the base in a selected position; a body supporting member supported on the tiltable frame assembly; and a feet-engaging member engageable with the bottom surface of the user's feet. The feet-engaging member is coupled to the tiltable frame assembly, and the body supporting member is configured to move in relation to the tiltable frame assembly and below the feet engaging member. Optionally, the body supporting member supports a mattress. When the body supporting member moves, the mattress supported by the it moves also, thereby achieving a relative movement between the feet-engaging member and the mattress and thereby to prevent sliding of the user's body with respect to the tiltable frame assembly when the body supporting member is moved to a vertical position. The multi-position support apparatus is capable of changing its height and angle in relation to the ground and moving from an approximately vertical position to an approximately horizontal position.

7 Claims, 7 Drawing Sheets

U.S. PATENT DOCUMENTS

| | | | |
|---|---|---|---|
| 4,685,159 | A | 8/1987 | Oetiker |
| 4,724,554 | A | 2/1988 | Kowalski et al. |
| 4,724,555 | A | 2/1988 | Poehner et al. |
| 5,023,967 | A | 6/1991 | Ferrand |
| 5,195,531 | A | 3/1993 | Bennett |
| 5,230,113 | A | 7/1993 | Foster et al. |
| 5,366,036 | A | 11/1994 | Perry |
| 5,638,563 | A | 6/1997 | Iura |
| 6,101,646 | A | 8/2000 | Son |
| 6,131,868 | A | 10/2000 | Welling |
| 6,781,517 | B2 | 8/2004 | Moster et al. |
| 6,862,762 | B1 | 3/2005 | Johnson et al. |
| 6,912,746 | B2 | 7/2005 | Grove |
| 7,058,999 | B2 | 6/2006 | Horitani |
| 7,296,312 | B2 | 11/2007 | Menkedick et al. |
| 2004/0004559 | A1 | 1/2004 | Rast |
| 2004/0210155 | A1 | 10/2004 | Takemura |
| 2006/0260051 | A1 | 11/2006 | Paz |
| 2007/0169267 | A1 | 7/2007 | Paz et al. |

OTHER PUBLICATIONS

International Search Report Dated Apr. 30, 2007 From the International Searching Authority Re. Application No. PCT/IL2006/000575.

Written Opinion Dated Apr. 30, 2007 From the International Searching Authority Re. Application No. PCT/IL2006/000575.

Official Action Dated Feb. 14, 2011 From the US Patent and Trademark Office Re.: U.S. Appl. No. 11/715,410.

Response Dated Nov. 24, 2010 to Official Action of Aug. 26, 2010 From the US Patent and Trademark Office Re.: U.S. Appl. No. 11/715,410.

Official Action Dated Apr. 3, 2009 From the US Patent and Trademark Office Re.: U.S. Appl. No. 11/715,410.

Official Action Dated Dec. 5, 2008 From the US Patent and Trademark Office Re.: U.S. Appl. No. 11/715,410.

Official Action Dated Feb. 16, 2010 From the US Patent and Trademark Office Re.: U.S. Appl. No. 11/715,410.

Official Action Dated Nov. 23, 2009 From the US Patent and Trademark Office Re.: U.S. Appl. No. 11/715,410.

Official Action Dated Aug. 26, 2010 From the US Patent and Trademark Office Re.: U.S. Appl. No. 11/715,410.

Response Dated Jan. 4, 2009 to Official Action of Dec. 5, 2008 From the US Patent and Trademark Office Re.: U.S. Appl. No. 11/715,410.

Response Dated May 10, 2010 to Official Action of Nov. 23, 2009 From the US Patent and Trademark Office Re.: U.S. Appl. No. 11/715,410.

Response Dated Jan. 21, 2010 to Official Action of Nov. 23, 2009 From the US Patent and Trademark Office Re.: U.S. Appl. No. 11/715,410.

Response Dated Jul. 31, 2009 to Official Action of Apr. 3, 2009 From the US Patent and Trademark Office Re.: U.S. Appl. No. 11/715,410.

Dismissed Petition Dated Aug. 18, 2011 From the US Patent and Trademark Office Re. U.S. Appl. No. 11/715,410.

Interview Summary Dated Jul. 26, 2011 From the US Patent and Trademark Office Re.: U.S. Appl. No. 11/715,410.

Notice of Appeal Dated Aug. 15, 2011 to Official Action of Feb. 14, 2011 From the US Patent and Trademark Office Re.: U.S. Appl. No. 11/715,410.

Advisory Action Before the Filing of An Appeal Brief Dated Apr. 18, 2011 From the US Patent and Trademark Office Re.: U.S. Appl. No. 11/715,410.

Response Dated Apr. 12, 2011 to Official Action of Feb. 14, 2011 From the US Patent and Trademark Office Re.: U.S. Appl. No. 11/715,410.

MULTI-POSITION SUPPORT APPARATUS WITH A MOVABLE FRAME

CROSS-REFERENCE TO RELATED APPLICATIONS

This application claims the benefit of U.S. Provisional Patent Application No. 61/090,433, filed on Aug. 20, 2008, and U.S. Provisional Patent Application No. 61/097,255, filed on Sep. 16, 2008. This application is also a Continuation-In-Part (CIP) of U.S. patent application Ser. No. 11/715,410, filed on Mar. 8, 2007. U.S. patent application Ser. No. 11/715,410 is a Continuation-In-Part (CIP) of PCT Patent Application No. PCT/IL2006/000575, filed on May 16, 2006, which is a Continuation-In-Part (CIP) of U.S. patent application Ser. No. 11/130,129 and U.S. patent application Ser. No. 11/130,130, both filed on May 17, 2005, and claims priority from U.S. Provisional Patent Application No. 60/715,147, and U.S. Provisional Patent Application No. 60/715,177, both filed on Sep. 9, 2005, and U.S. Provisional Patent Application No. 60/738,592, filed on Nov. 22, 2005.

TECHNICAL FIELD

The embodiments of the present invention relate to a multi-position support apparatus, such as a bed, and more particularly, to a multi-position support apparatus with a movable frame.

BACKGROUND

Hereinafter, the term "engine" refers to any device that is able to move things, including, but not limited to motor or actuator.

Basic principles and details relating to a multi-position bed featuring a movable frame needed for properly understanding the embodiments of the present invention are provided herein. Complete theoretical descriptions, details, explanations, examples, and applications of these and related subjects and phenomena are readily available in standard references in the fields of physics, electronics, homecare devices, and elderly care.

To date, the inventor is unaware of prior art teaching of a multi-position bed featuring a foot support coupled to a tilting element, and a mattress coupled to a moving frame that moves in relation to the tilting element.

Thus there is a need for, and it would be highly advantageous to have, a multi-position bed with a movable frame.

BRIEF SUMMARY

A multi-position support apparatus including a foot support, a tilting element, and a moving frame. The foot support is coupled to the tilting element, and the moving frame is configured to move in relation to the tilting element and below the foot support. Optionally, the moving frame supports a mattress. When the moving frame moves, the mattress supported by the moving frame moves also, thereby achieving a relative movement between the foot support and the mattress. The multi-position support apparatus is capable of changing its height and angle in relation to the ground and moving from an approximately vertical position to an approximately horizontal position.

The embodiments of the present invention are readily implemented using standard hardware components and standard software modules. Moreover, the embodiments are generally applicable as a 'stand-alone' multi-position support apparatus, such as a multi-position bed, or as a multi-position support apparatus used in combination with other methods, devices, and systems, performing various operations.

Implementation of the multi-position support apparatus embodiments involves performing or completing selected tasks or steps manually, semi-automatically, fully automatically, and/or a combination thereof. Moreover, depending upon actual instrumentation and/or equipment used for implementing a particular embodiment of the disclosed system and corresponding method, several embodiments could be achieved by hardware, by software on any operating system of any firmware, or a combination thereof. In particular, as hardware, embodiments of the invention could exist by variations in the physical structure. Additionally, or alternatively, as software, selected functions of the invention could be performed by a data processor, such as a computing platform executing software instructions or protocols using any suitable computer operating system.

BRIEF DESCRIPTION OF THE DRAWINGS

The embodiments of the present invention are herein described, by way of example only, with reference to the accompanying drawings. With specific reference now to the drawings, it is stressed that the particulars shown are by way of example and for purposes of illustrative discussion of the embodiments of the present invention only, and are presented in order to provide what is believed to be the most useful and readily understood description of the principles and conceptual aspects of the embodiments. In this regard, no attempt is made to show structural details of the embodiments in more detail than is necessary for a fundamental understanding of the invention, the description taken with the drawings making apparent to those skilled in the art how the several forms of the invention may be embodied in practice. In the drawings.

DETAILED DESCRIPTION

Figure 1:
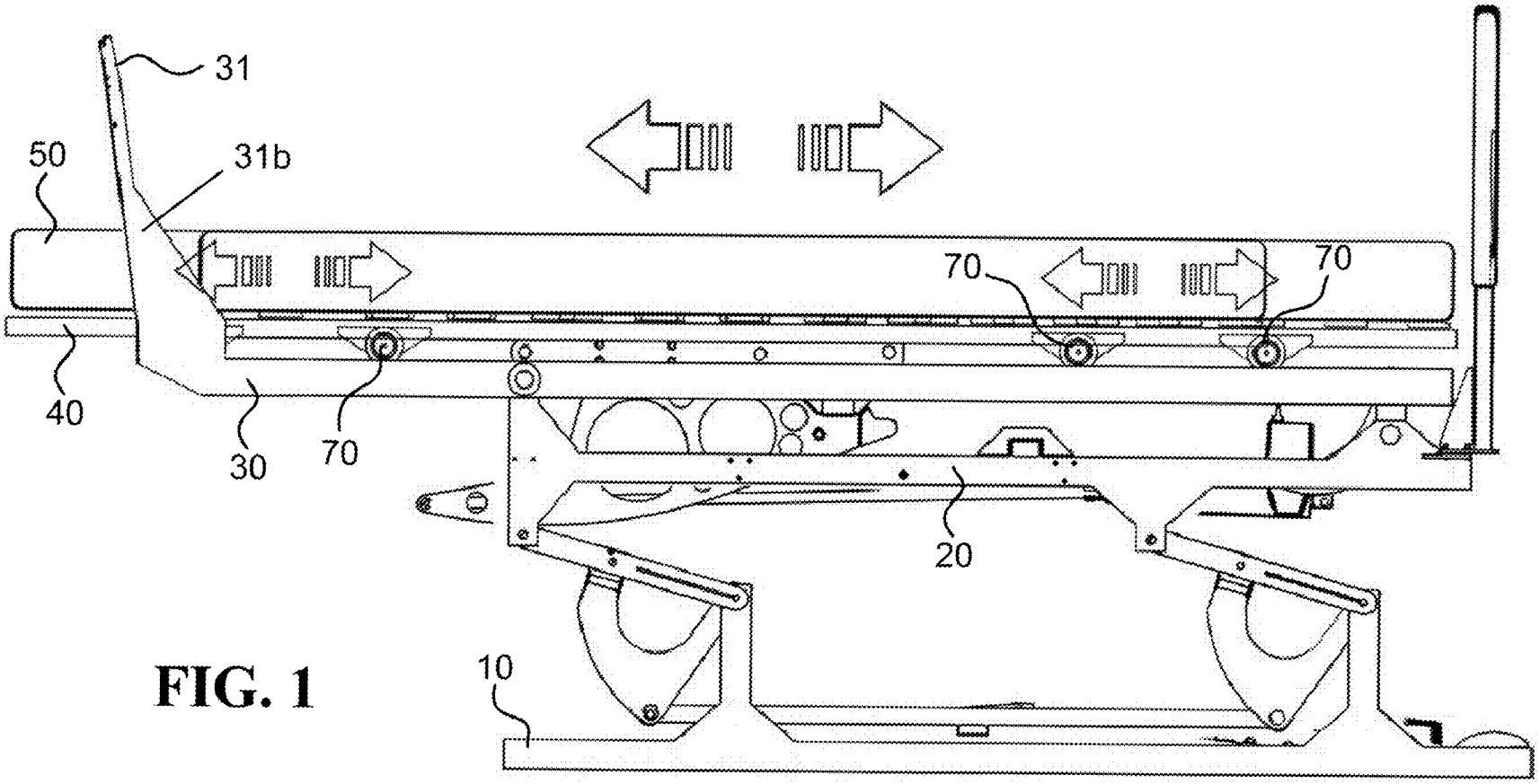
FIG. 1 illustrates a horizontal movement of the moving frame of a multi-position bed, in accordance with the present invention.

In the following description, numerous specific details are set forth. However, the embodiments of the invention may be practiced without these specific details. In other instances, well-known hardware, software, materials, structures and techniques have not been shown in detail in order not to obscure the understanding of this description. In this description, references to "one embodiment" or "an embodiment" mean that the feature being referred to is included in at least one embodiment of the invention. Moreover, separate references to "one embodiment" in this description do not necessarily refer to the same embodiment. Illustrated embodiments are not mutually exclusive, unless so stated and except as will be readily apparent to those of ordinary skill in the art. Thus, the invention may include any variety of combinations and/or integrations of the embodiments described herein. Also herein, flow diagrams illustrate non-limiting embodiment examples of the methods, and block diagrams illustrate non-limiting embodiment examples of the devices. Some flow diagrams operations are described with reference to the embodiments illustrated by the block diagrams. However, the methods of the flow diagrams could be performed by embodiments of the invention other than those discussed with reference to the block diagrams, and embodiments discussed with reference to the block diagrams could perform operations different than those discussed with reference to the flow diagrams. Moreover, although the flow diagrams may depict serial operations, certain embodiments could perform certain operations in parallel and/or in different orders than those depicted. Moreover, repeated reference numerals and/or letters in the text and/or drawings are for the purpose of simplicity and clarity and do not in themselves dictate a relationship between the various embodiments and/or configurations discussed.

Unhealthy people in different conditions and elderly people have difficulty bending over and moving from a standing position to a sitting position, and vice versa. As a result, the action of sitting down on a bed is difficult for them. Overweight and/or obese people sometimes find it difficult to bend their knees when sitting down on a bed, and have difficulty rising up off a bed.

The disclosed embodiments of the multi-position support apparatus, referred to as multi-position bed, receive and lower the user from a standing position (while both the multi-position bed and user are about vertical), into a reclining or horizontal position, optionally without having to tie and/or secure the user to the multi-position bed before the angular position change occurs. Then, when the user wants to get out of the multi-position bed, the multi-position bed raises the user from lying down to standing up.

According to the present invention, there is provided supporting apparatus for supporting a user in a selected position including a horizontal position, a reclining position, and a substantially vertical position to facilitate exiting from the apparatus, said supporting apparatus comprising: a base for supporting the apparatus on a flat horizontal surface; a tiltable frame assembly tiltably supported on said base in said selected position, and including a head section and a foot section at its opposite ends; and a body supporting member supported on said tiltable frame assembly and having a head end and foot end proximal to said head section and foot section, respectively, of said tiltable frame assembly; characterized in that said foot section of the tiltable frame assembly includes a feet-engaging member engageable with the bottom surfaces of the user's feet, when the user is supported on said body supporting member, and in that said feet-engaging member is fixed to said foot section of the tiltable frame assembly by a pair of arms straddling the body supporting member so as to define an aperture therewith; and wherein said body supporting member is movable along the length of the tiltable frame assembly through said aperture; and further characterized in that said body supporting member is moveable with respect to said tiltable frame assembly such that: in the horizontal position of the tiltable frame assembly, the body supporting member supports the user's body with the foot-engaging member longitudinally spaced from the bottom surfaces of the user's feet; and when the tiltable frame assembly is tilted to the vertical position, the body supporting member moves longitudinally on the tiltable frame assembly to cause the bottom surfaces of the user's feet to engage the feet-engaging member of the tiltable frame assembly and thereby to prevent sliding of the user's body with respect to the tiltable frame assembly.

Figure 2:
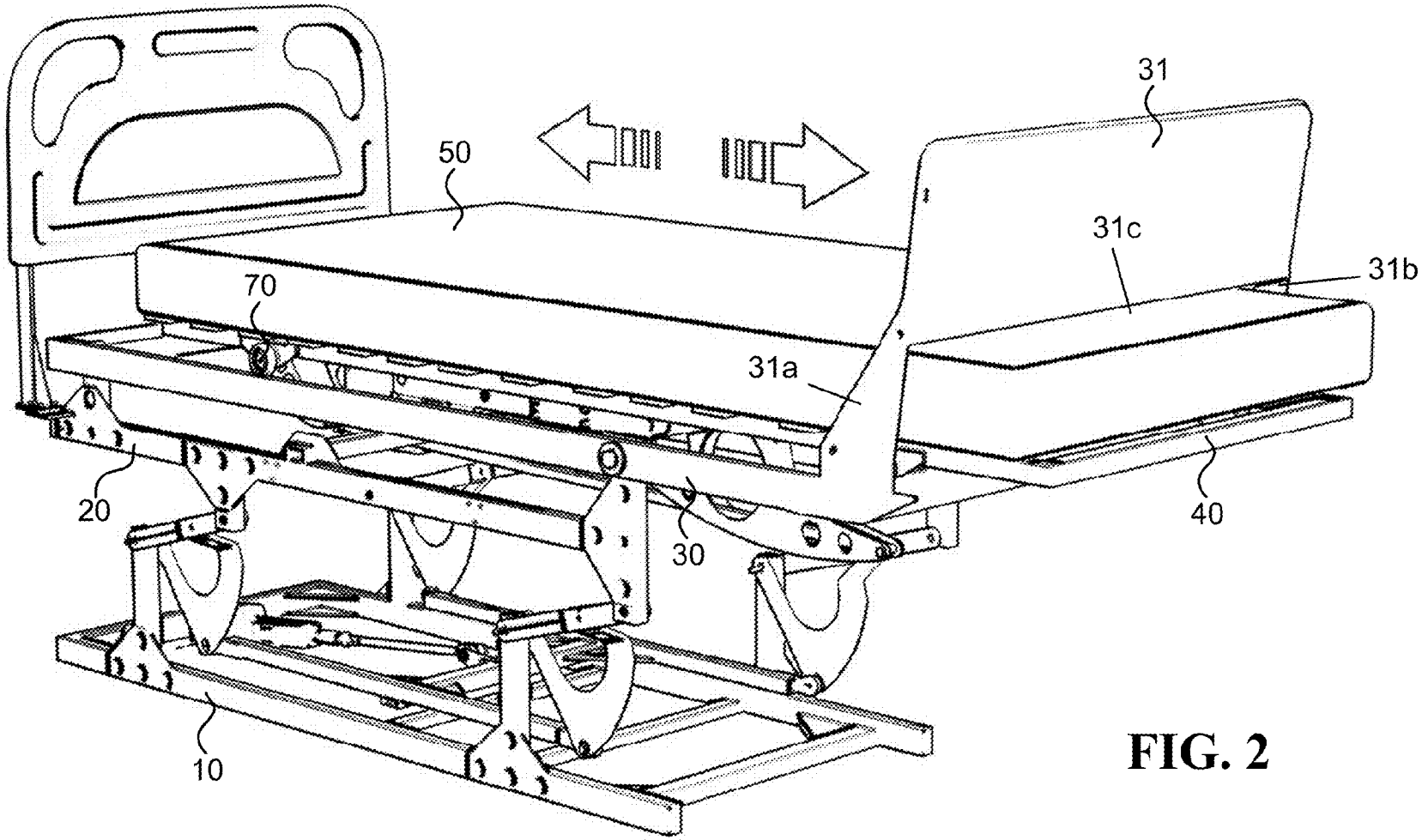
FIG. 2 illustrates a horizontal movement of the moving frame of a multi-position bed, in accordance with the present invention.

Referring to the figures, FIG. 1 and FIG. 2 illustrate one embodiment of a multi-position bed comprising a base 10, an optional lifting mechanism 20, a tiltable frame assembly 30, a feet-engaging member 31 coupled to the tiltable frame assembly 30, and a body supporting member 40 movably supported on the tiltable frame assembly 30.

Optional mattress 50 is carried by the body supporting member 40. In the illustrated embodiment, the feet-engaging member 31 is fixed to the tiltable frame assembly 30 and does not move independently. Therefore, when the tiltable frame assembly 30 moves, the feet-engaging member 31 also moves. When the body supporting member 40 moves in relation to the tiltable frame assembly 30, the feet-engaging member 31 does not move and therefore a relative movement between the body supporting member 40 and the feet-engaging member 31 is obtained. Due to the fact that the mattress 50 is carried by the moving body supporting member 40, the relative movement between the tiltable frame assembly 30 and the moving body supporting member 40 causes a relative movement between a user on the mattress 50 and the feet-engaging member 31. As a result, the distance between the user's feet and the feet-engaging member 31 can be controlled by controlling the relative position of the body supporting member 40 in relation to the tiltable frame assembly 30.

When lifting mechanism 20 is moved up and down, it changes the position of the tiltable frame assembly 30 and the feet-engaging member 31 in relation to the floor. When the tiltable frame assembly 30 is in maximum tilt and the lifting mechanism 20 is lowered, the feet-engaging member 31 is approximately parallel to the ground, i.e., in a horizontal position. On the other hand, when the tiltable frame assembly 30 is substantially in a horizontal position, the body supporting member 40 is also in a substantially horizontal position, and the feet-engageable member 31 is in a substantially vertical position.

In one embodiment, wheels, bearings, ball bearings, roller bearings, slides, and/or pistons, all referred to as bearings 70, are utilized for enabling the movement of the movable body supporting member 40 in relation to the tiltable frame assembly 30. Optionally, the body supporting member 30, to which the mattress is coupled, is actuated by an engine.

In one embodiment, it is possible to change the position of the feet-engaging member 31 in relation to the tiltable frame assembly 30. In one embodiment, it is possible to bring the feet-engaging member 31 up or down in relation to the tiltable frame assembly 30.

Figure 3:
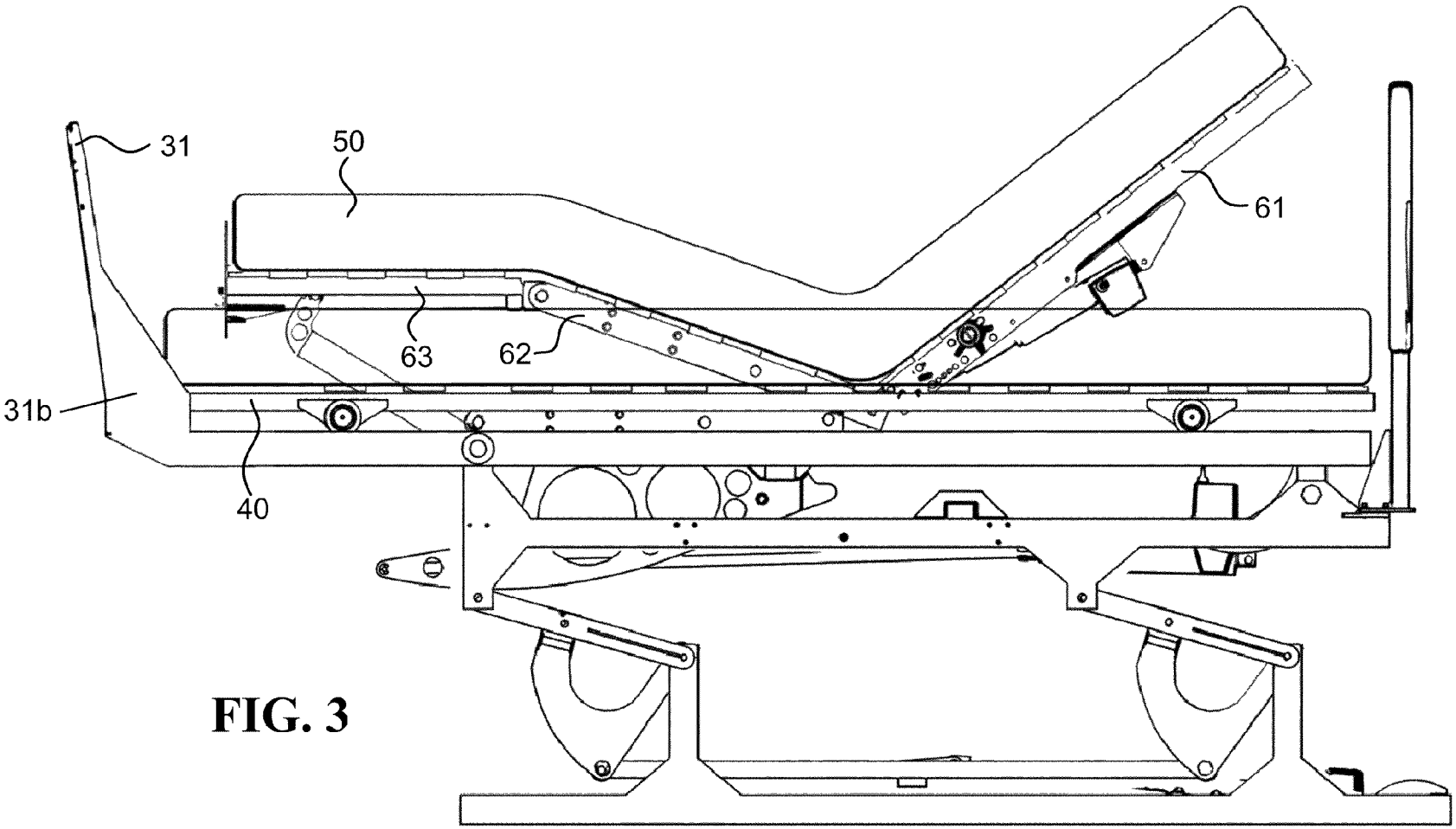
FIG. 3 illustrates a sitting position of the multi-position bed, in accordance with the present invention.

In one embodiment, the tiltable frame assembly 30 may include at least two angular support sections which may change their relative angular positions. FIG. 3 illustrates a tiltable frame assembly 30 having three angular support sections. The first angular support section 61 serves as the back and head rest, the second angular support section 62 serves as the seat, and the third angular support section 63 serves as the leg and feet rest. As shown particularly in FIG. 2, the feet-engaging member 31 is fixed to the foot end of the tiltable frame assembly 30 by a pair of arms 31*a*, 31*b* straddling the opposite sides of the movable body supporting member 40. As seen particularly in FIG. 2, the two arms 31*a*, 31*b* define, with the feet-engaging member 31, an aperture 31*c* through which the body supporting member 40 is moved when moved along the length of the tiltable frame assembly 30.

While changing the angular position between the different angular support sections 61-63 of the tiltable frame assembly 30, the multi-position bed may change or maintain the position of the feet-engaging member 31 in relation to the body supporting member 40. Optionally, the multi-position bed may also change the angular position between the various angular support sections 61-63 while maintaining the relative position between the mattress 50 and the feet-engaging member 31. Alternatively, the multi-position bed may change the angular position between the angular support sections 61-63 while also changing the relative position between the mattress 50 and the feet-engaging member 31.

FIG. 3 also illustrates the possibility of changing the multi-position bed from a lying position to a sitting position. Since feet-engaging member support 31 is fixed to the tiltable frame assembly 30, it does not move when the mattress 50, carried on the body supporting member 40, moves. Thus if the user wishes to have more space between his legs and the feet-engaging member 31 when lifting the back rest using the angular support sections 61-63, the user may move the body supporting member 40 over the tiltable frame assembly 30, and thereby draw away from the feet-engaging member 31.

Figure 4:
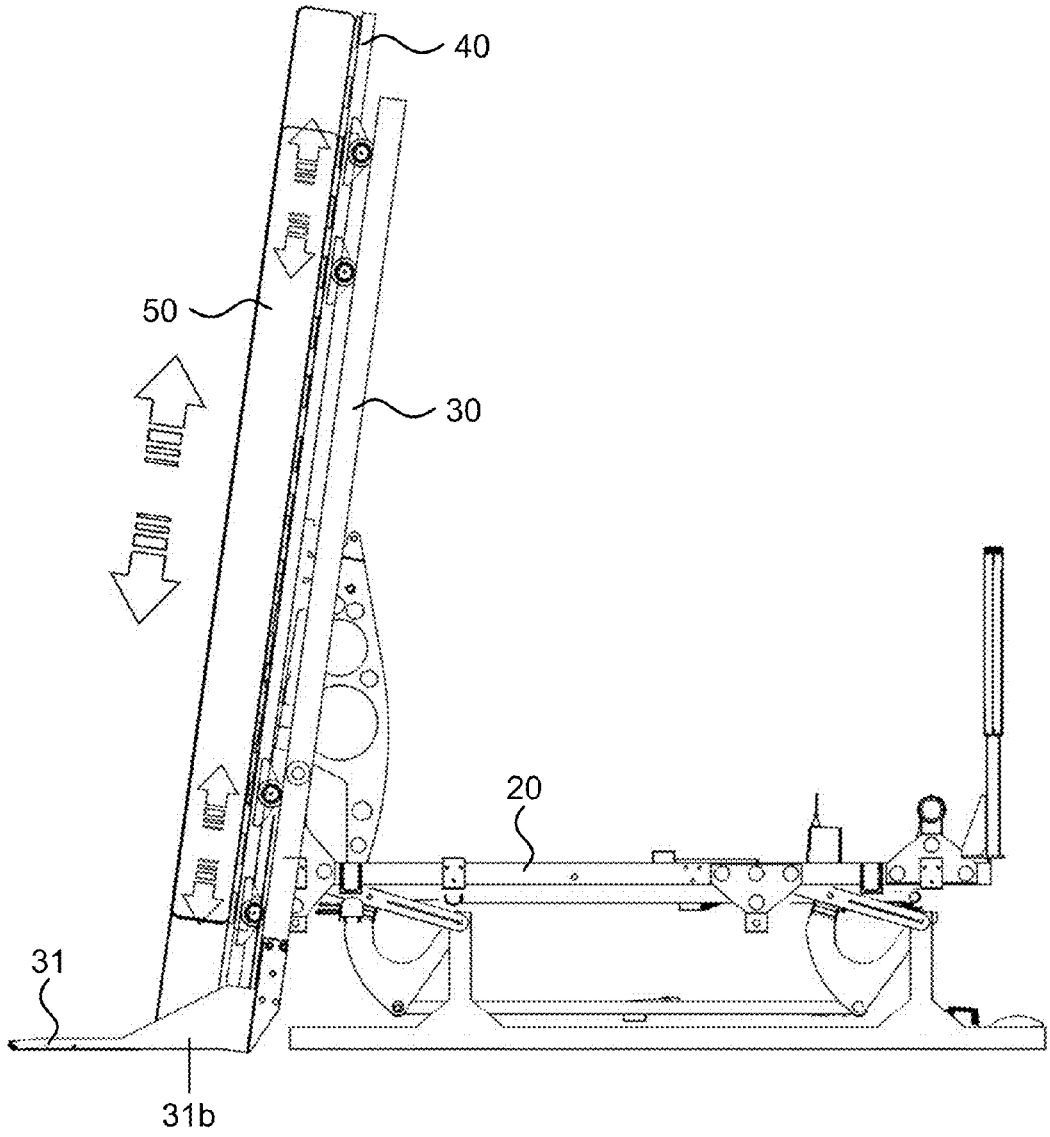
FIG. 4 illustrates an approximately vertical movement of the moving frame and the tilting element, in accordance with the present invention.

FIG. 4 illustrates an embodiment of a multi-position bed with the body supporting member 40 in a standing or vertical position. In this position, the frame assembly 30 tilts the body supporting member 40 into an approximately vertical position, and the body supporting member 40 moves up or down. As the body supporting member moves, a user who is lying on the optional mattress 50 also moves with the mattress 50 carried by the body supporting member 40. The feet-engaging member 31 prevents the user from sliding as the multi-position bed shifts from a lying position to a standing position and/or when the multi-position bed shifts from a sitting position to a standing position. When the user wishes to stand up from lying down or sitting position, the body supporting member 40 moves toward the foot of the bed until the user's feet reach the feet-engaging member 31 that is coupled to the tillable frame assembly 30.

Figure 5:
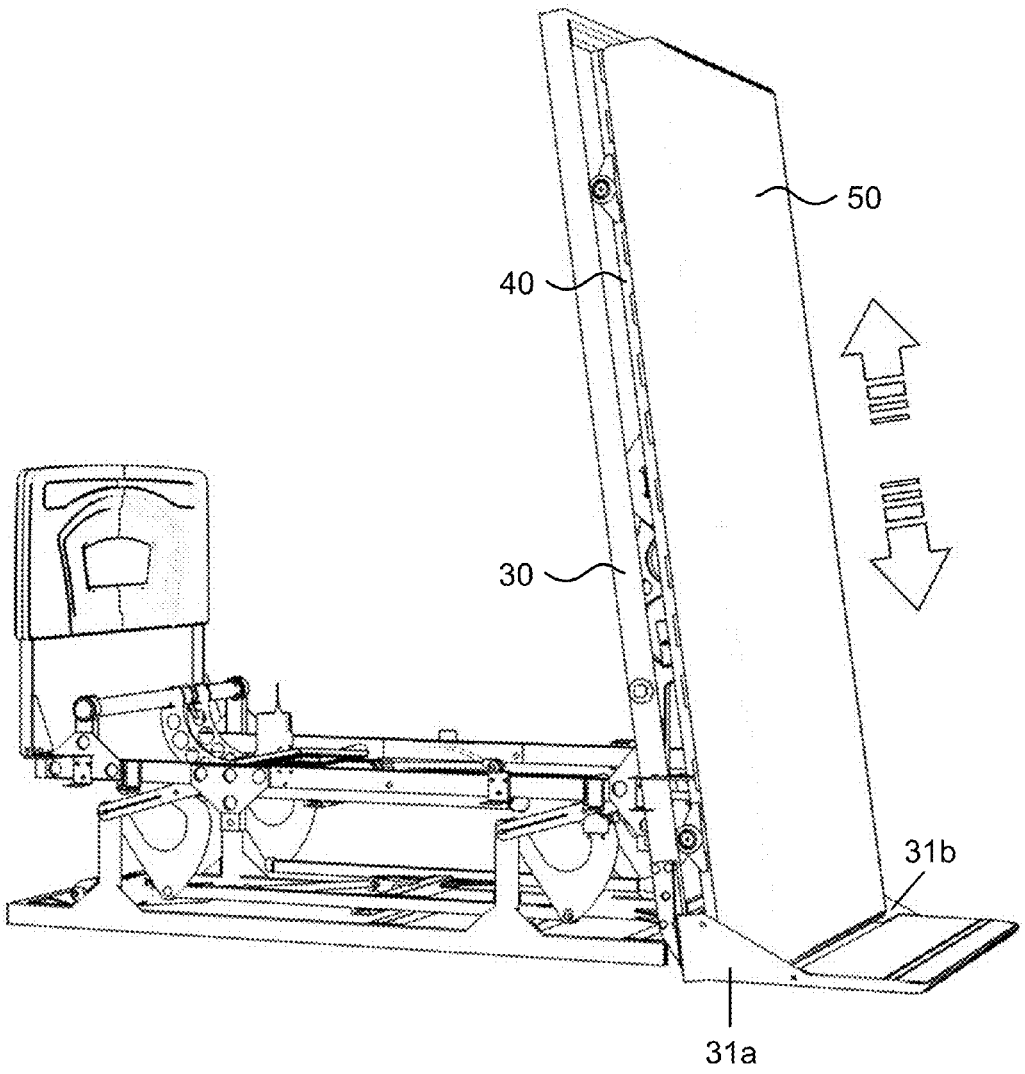
FIG. 5 illustrates an approximately vertical movement of the moving frame and the tilting element, in accordance with the present invention.

FIG. 5 illustrates another viewpoint of the movement of the body supporting member 40 with the optional mattress 50 in relation to the tiltable frame assembly 30.

Figure 6:
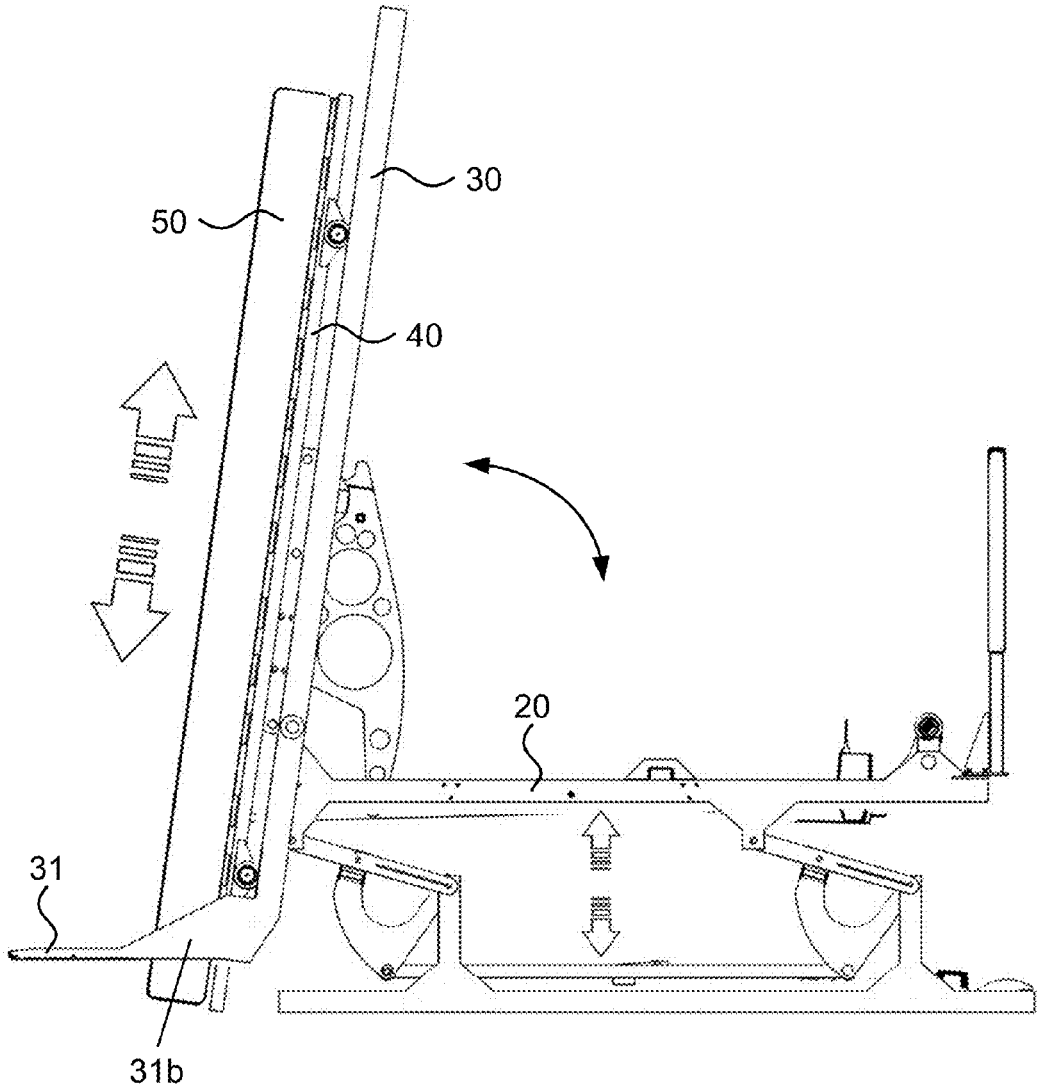
FIG. 6 illustrates an approximately vertical movement of the moving frame, and up and down movement of the lifting section of a multi-position bed, in accordance with the present invention.

FIG. 6 illustrates an embodiment of a multi-position bed with the movable body supporting member 40, wherein its configuration is changed from a reclining position to a standing position or vice versa. FIG. 6 also illustrates the capability of the optional lifting mechanism 20 to raise and lower the tiltable frame assembly 30 and the body supporting member 40. The feet-engaging member 31 that is fixed to the tiltable frame assembly 30 also moves up and down with the lifting mechanism 20. In order to bring the user from a reclining position to a standing position, the body support member 40 with the mattress 50 moves down, such that the user's feet touch the feet-engaging member 31. The latter prevents the user from sliding as the multi-position bed shifts from a reclining position to a standing position and/or as the multi-position bed shifts from a sitting position to a standing position. When the user's feet are engaged by the feet-engaging member 31 and the tiltable frame assembly 30 is at a certain angle, such as above 45 degrees, movement of the body supporting member 40, with or without the mattress 50, changes the position of the user on the body supporting member 40, while keeping the user standing on the feet-engaging member 31, such that the location of the body supporting member 40 in relation to the ground changes, while the location of the user does not change as he stands on the feet-engaging member 31. The movements of the lifting mechanism 20, the tiltable frame assembly 30, and the body supporting member 40 can either occur simultaneously or sequentially.

It is to be understood that the multi-position bed may have a plurality of states and configurations. For example, the operation of the tiltable frame assembly 30 and the lifting mechanism 20 may bring the feet-engaging member 31 approximately to the ground. Alternatively, operation of the tiltable frame assembly 30 and the lifting mechanism 20 may bring the feet-engaging member 31 to a predefined height above the ground.

Figure 7:
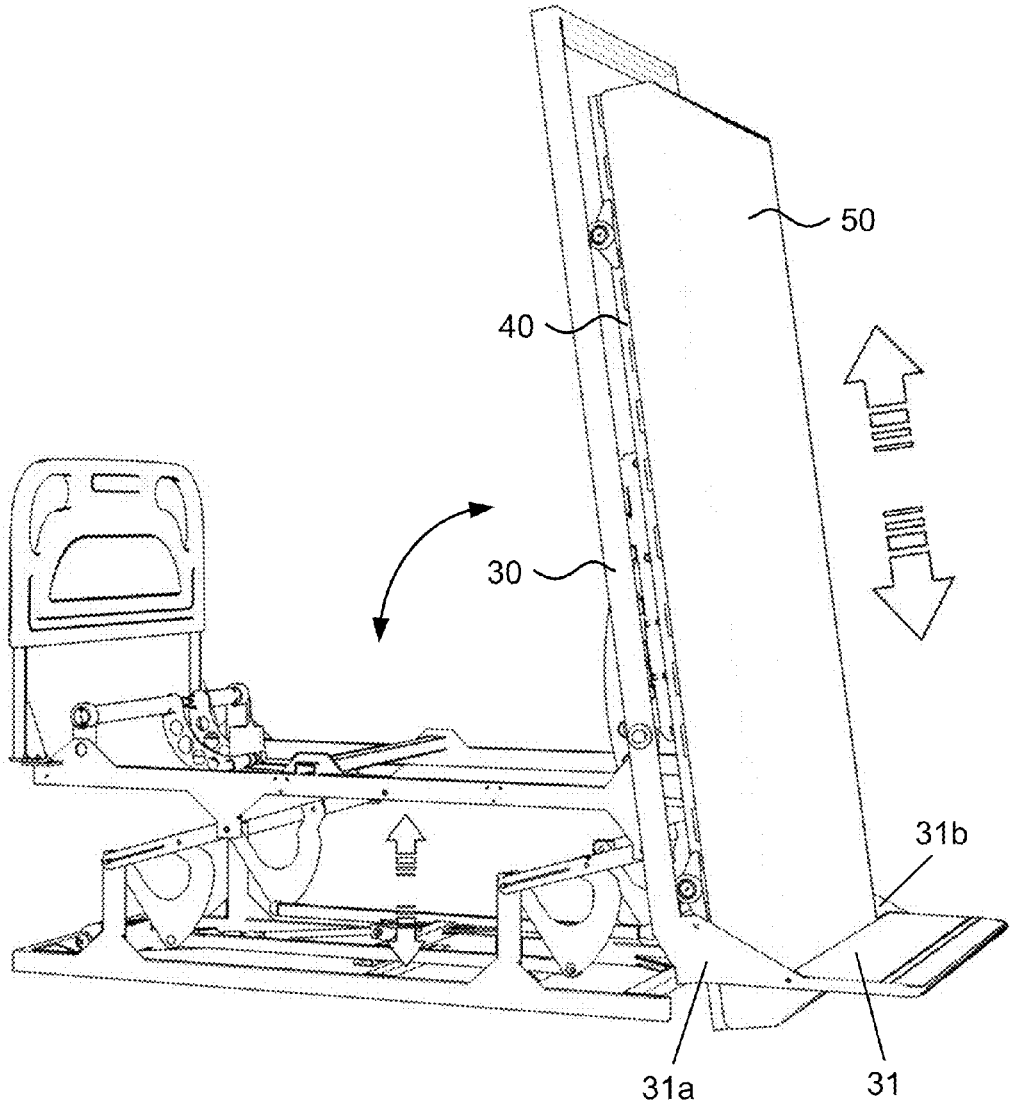
FIG. 7 illustrates an approximately vertical movement of the moving frame and the tilting element, in accordance with the present invention.

FIG. 7 illustrates from another point of view the embodiment of a multi-position bed with a movable frame, wherein the configuration is changed from a reclining position to a standing position.

Due to the fact that the multi-position bed may move up, down, and to the side utilizing the lifting mechanism 20 and the tilting frame assembly 30, a three-dimensional movement of the body supporting member 40 becomes possible and enables the user to be brought to many positions.

Detecting when the feet of the user lying in the multi-position bed have reached the feet-engaging member 31 may be achieved in various ways, such as, but not limited to, using a pressure sensor that measures the user's legs' intensity of resistance. The minimal threshold of intensity measured by the sensor should be set to a value that is high enough to ensure that the user's feet have actually reached the feet-engaging member, and not another object that may be on the multi-position bed. For example, as a safety precaution, the user is not brought to a standing position while stepping on a blanket or a pillow.

However, if the user indeed wants to be brought to a standing position while stepping on a blanket or a pillow, the pressure sensor should be configured and set to ensure that a minimal predefined amount of pressure is applied, implying that the object is pressed to the user's feet. Only when the appropriate amount of pressure is measured by the sensor, will the multi-position bed begin to rise to a standing position. In another embodiment, the sensor is a proximity sensor, or any other sensor able to detect the relative location of the user's feet in relation to the foot support.

In one embodiment, when the user wishes to be brought to a standing position, the tiltable frame assembly 30 of the multi-position bed starts to change its angular position as the body supporting member 40 moves towards the direction of the foot end of the multi-position bed. Performing these two actions simultaneously saves time and does not endanger the user, as long as the user's feet reach the feet-engaging member in a reasonable amount of time in relation to the angular position of the multi-position bed.

In order for the user to avoid having to descend a step when brought into standing position, and optionally to avoid friction of the user on the mattress, when the multi-position bed reaches a predefined angle, the lifting mechanism 20 to which the tiltable frame assembly 30 is coupled starts to come down so that the feet-engaging member 31 is in close proximity to ground level.

In one embodiment, the multi-position bed features wheels which enable it to move. In an alternative embodiment, the wheels which enable the multi-position bed to move are motorized. In the case where the wheels which enable the bed to move are motorized, it is possible to control the movement of the bed using a control panel. The control panel allows the user to operate the different engines separately, and/or to perform complete operations such as the transition from a standing position to a sitting position and vice versa, the transition from a standing position to a lying position and vice versa, and the transition from a sitting position to a lying position and vice versa. Optionally, the control panel allows the user to stop the multi-position support apparatus in any of the intermediate states of the above described complete operations.

In one embodiment, the multi-position bed is equipped with a toilet bowl. Optionally, when the toilet bowl is being used, the multi-position bed shifts to a sitting position. Optionally, the toilet bowl usage is indicated by the user via a control panel (not shown in the figures).

In one embodiment, the multi-position bed may also be used as a chair. In one embodiment, the multi-position bed may be moved into a sitting position, like a TV recliner.

In one embodiment, the multi-position bed is utilized for a bathing or washing system. In this case, the bathing or washing system may further include one or more sprinklers, one or more dryers, a drain system, and other bathing related devices.

In one embodiment, the multi-position bed is capable of identifying the user. Then, a personalized program may be executed. Angles and velocities are examples of some of the parameters which may be saved in the personalized program.

In one embodiment, the multi-position bed is operated manually. The manual operating program activates each step/stage according to instructions from either the user or any other human operator. Alternatively, the multi-position bed is operated by an automatic program that activates all stages, sequentially. Alternatively, the multi-position bed is operated by one of the following, or by a combination thereof: (a) the user, (b) an operator who is not the user, (c) from any place where it is possible to control the operations of the multi-position bed via remote control or any other remote operating means as known in the art, or, (d) automatically, using methods known in the art.

In one embodiment, prior to executing the program, the multi-position bed activates a voice indicator which informs the user of the program to be executed. The program is activated only after the user confirms the voice-indication. The user may confirm execution of the program by any input means known in the art, such as pressing a confirmation button, or by voice-command.

In one embodiment, the multi-position bed features an interface from which a variety of operations are controlled. For example, the controller may be operated by the following means: manual, keyboard, voice-activation, computer-connected, for example via RS232 or USB, remote activation such as by telephone or wireless network, or by any other means known in the art. In one embodiment, all or some of the parameters that have been user-customized, such as user programs, angles, heights, and angular change velocity, are backed up. Parameters customized for the user may be saved in the multi-position bed or in any computer, or memory element, capable of communicating with the multi-position bed.

In one embodiment, the multi-position bed features a Built in Test (BIT). The BIT system may be used for swift identification of failures. This capability enables a technician to determine what action should be taken. The BIT also makes it easier to provide price quotes to a user prior to responding for repairs. Optionally, the BIT results may be transferred to the technician's equipment via a phone line or wireless network, or any other communication aid known in the art.

In one embodiment, when installing the multi-position bed at the user's site, the technician is able to set a combination of velocities, movement angles, and other parameters referred to herein as "operational customized parameters" of the multi-position bed such that it is possible to conform the use of the multi-position bed to the requirements, comfort and safety of the specific user. Optionally, the operational customized parameters are saved in a memory element for future use.

In an emergency, the multi-position bed may operate a predefined emergency response operation, such as, but not limited to, bringing the user to a predefined angular position. The angular position into which the user is brought in an emergency may be the most secure angular position for the specific user. Entering the emergency response operation may be initialized by any kind of appropriate device, such as, but not limited to, emergency button, emergency pull-rope, voice command, etc.

The embodiments of the present invention are not limited to the details of the order or sequence of steps of operation or implementation of the embodiments and corresponding method set in the description, drawings, or examples of the embodiments of the present invention.

While the invention has been described in conjunction with specific embodiments and examples thereof, it is to be understood that they have been presented by way of example, and not limitation. Moreover, it is evident that many alternatives, modifications and variations will be apparent to those skilled in the art. Accordingly, it is intended to embrace all such alternatives, modifications and variations.

What is claimed is:

1. Supporting apparatus for supporting a user in a selected position including a horizontal position, a reclining position, and a substantially vertical position to facilitate exiting from the apparatus, said supporting apparatus comprising:

a base for supporting the apparatus on a flat horizontal surface;

a tiltable frame assembly tiltably supported on said base in said selected position, and including a head section and a foot section at its opposite ends;

and a body supporting member supported on said tiltable frame assembly and having a head end and foot end proximal to said head section and foot section, respectively, of said tiltable frame assembly;

characterized in that said foot section of the tiltable frame assembly includes a feet-engaging member engageable with the bottom surfaces of the user's feet, when the user is supported on said body supporting member, and in that said feet-engaging member is fixed to said foot section of the tiltable frame assembly by a pair of arms straddling the body supporting member so as to define an aperture therewith; and wherein said body supporting member is movable along the length of the tiltable frame assembly through said aperture;

and further characterized in that said body supporting member is moveable with respect to said tiltable frame assembly such that:

(a) in the horizontal position of the tiltable frame assembly, the body supporting member supports the user's body with the feet-engaging member longitudinally spaced from the bottom surfaces of the user's feet; and (b) when the tiltable frame assembly is to be tilted to the vertical position, the body supporting member moves longitudinally on the tiltable frame assembly to cause the bottom surfaces of the user's feet to engage the feet-engaging member of the tiltable frame assembly and thereby to prevent sliding of the user's body with respect to the tiltable frame assembly.

2. The supporting apparatus according to claim 1, wherein the apparatus further comprises a lifting mechanism between said base and said tiltable frame assembly for selectively supporting the user also in an elevated position.

3. The supporting apparatus according to claim 1, wherein said tiltable frame assembly also includes a seat section pivotally connected at its opposite ends to said head and foot sections of the tiltable frame assembly, to thereby enable the apparatus to support the user's body also in a sitting position.

4. The supporting apparatus according to claim 1, wherein said body supporting member includes a mattress on its upper surface for receiving the user's body.

5. The supporting apparatus according to claim 1, wherein said body supporting member includes rollers on its under surface for facilitating its longitudinal movement on the tiltable frame assembly.

6. The supporting apparatus according to claim 1, wherein said feet-engaging member is fixed to said foot section of the tiltable frame assembly.

7. The supporting apparatus according to claim 1, wherein said feet-engaging member is configured to be oriented substantially vertically when the tiltable frame assembly supports the body supporting member in a horizontal position, and substantially horizontally when the tiltable frame assembly supports the body supporting member in a substantially vertical position.

* * * * *